US005551678A

United States Patent [19]

Michalik et al.

[11] Patent Number: 5,551,678

[45] Date of Patent: Sep. 3, 1996

[54] CYLINDER FOLDING APPARATUS

[75] Inventors: Horst B. Michalik, Höchberg; Otto T. Weschenfelder, Würzburg, both of Germany

[73] Assignee: Koenig & Bauer Aktiengesellschaft, Wurzburg, Germany

[21] Appl. No.: 361,576

[22] Filed: Dec. 22, 1994

[30] Foreign Application Priority Data

Dec. 24, 1993 [DE] Germany ..... 43 44 620.5

[51] Int. Cl.[6] ..... B41F 13/56; B41L 43/08

[52] U.S. Cl. ..... 270/20.1; 270/8; 270/37; 270/42; 493/426; 493/428

[58] Field of Search ..... 270/6, 13, 14, 270/15, 19, 20.1, 21.1, 37, 38, 47, 48, 49, 50, 8, 42; 493/424, 425, 426, 427, 428, 429, 432

[56] References Cited

U.S. PATENT DOCUMENTS

| | | | |
|---|---|---|---|
| 732,322 | 6/1903 | Spalckhaver | 270/37 |
| 880,499 | 3/1908 | Bechman | 493/428 X |
| 1,900,288 | 3/1933 | Jordhoy | 270/50 |
| 2,122,796 | 7/1938 | Horton | 493/427 X |
| 2,137,978 | 11/1938 | Mills et al. | 270/37 |
| 2,709,808 | 6/1955 | Murrell et al. | 227/81 |
| 3,038,719 | 6/1962 | Tyma | 270/50 |
| 3,762,697 | 10/1973 | Bolza-Schunemann | 270/6 |
| 4,147,337 | 4/1979 | Bolza-Schunemann | 270/19 |
| 4,190,242 | 2/1980 | Bolza-Schunemann | 270/50 |
| 4,273,320 | 6/1981 | Fujishiro | 493/427 |
| 4,279,410 | 7/1981 | Bolza-Schunemann . | |
| 4,344,610 | 8/1982 | Jeschke et al. | 270/21.1 X |
| 4,648,586 | 3/1987 | Michalik | 270/42 X |
| 4,840,364 | 6/1989 | Schneider | 270/38 |
| 4,892,297 | 1/1990 | Kobler | 270/21.1 X |
| 4,974,822 | 12/1990 | Richter | 270/21.1 X |
| 5,072,919 | 12/1991 | Schneider et al. | 493/426 X |
| 5,096,174 | 3/1992 | Nishihara . | |
| 5,390,905 | 2/1995 | Melchior | 270/21.1 |
| 5,468,209 | 11/1995 | Rohrhiursch et al. | 493/424 |

FOREIGN PATENT DOCUMENTS

| | | |
|---|---|---|
| 0023630 | 2/1981 | European Pat. Off. . |
| 0267457 | 5/1988 | European Pat. Off. . |
| 2846191 | 1/1981 | Germany . |
| 3540062 | 5/1987 | Germany . |
| 4017645 | 1/1991 | Germany . |
| 1229563 | 4/1971 | United Kingdom . |
| 1333866 | 10/1973 | United Kingdom . |

*Primary Examiner*—John E. Ryznic
*Attorney, Agent, or Firm*—Jones, Tullar & Cooper, P.C.

[57] ABSTRACT

A cylinder folding apparatus for a web-fed rotary printing press utilizes solid cutting and a collecting cylinders to cut a paper web into signatures. A hollow folding drum is provided with an interior folding blade cylinder whose axis of rotation is offset from that of the folding drum. A pair of folding rollers are placed adjacent the folding drum. A stapling device may also be placed adjacent the hollow folding drum. The folding apparatus is intended to cut thick signatures at high production speeds as well as to produce stapled tabloid products.

10 Claims, 1 Drawing Sheet

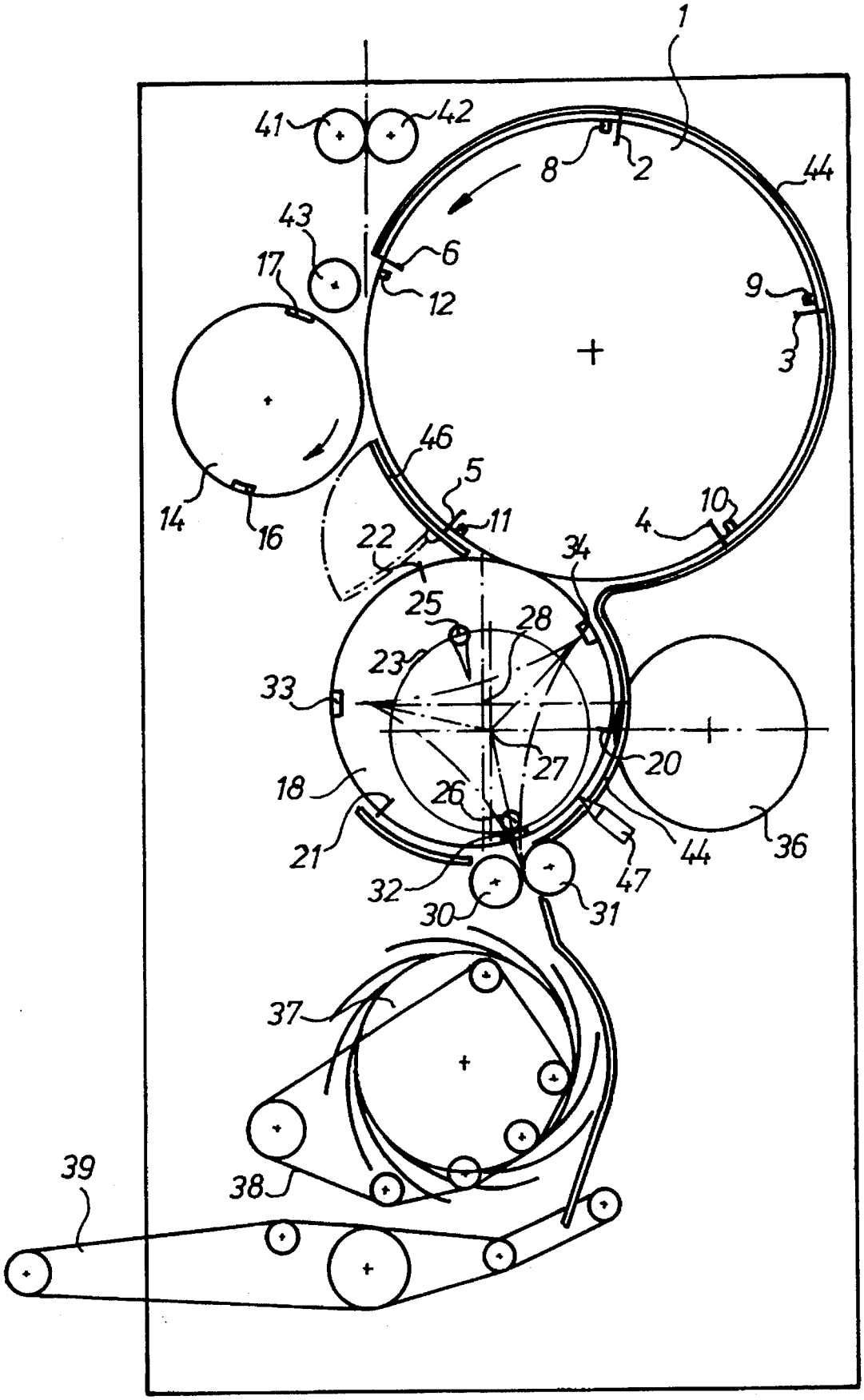
1
41
42
8
2
44
43
6
17
12
9
3
46
5
14
16
22
11
4
10
34
25
28
23
33
27
20
18
26
21
44
36
32
47
30
31
37
39
38

CYLINDER FOLDING APPARATUS

FIELD OF THE INVENTION

The present invention is directed generally to a cylinder folding apparatus. More particularly, the present invention is directed to a cylinder folding apparatus in a web-fed rotary printing press. Most specifically, the present invention is directed to a cylinder folding apparatus usable in a rotary printing press and performing collection and double production. The cylinder folding apparatus has a two section solid cutting cylinder and a cooperating five section solid collection cylinder. A hollow three section folding drum carries an eccentrically positioned two section folding blade support which rotates inside the folding drum. A stapling device can be placed to cooperate with the hollow folding drum and the folded production from the cylinder folding apparatus are delivered to a paddle wheel and thence to an endless removal chain.

DESCRIPTION OF THE PRIOR ART

In rotary web-fed printing presses, a continuous paper web train, which may have been longitudinally folded, is directed to a folding apparatus. Here the paper web train is cross cut into a plurality of web segments. These segments are then cross folded, by operation of a folding blade, into folded signatures. One prior art cylinder folding apparatus, which is operable in double and collection production, is shown in U.S. Pat. No. 3,038,719. In this device there is provided a 3/3 folding drum with a folding blade support that rotates in an eccentric manner within the folding drum. A 2/2 cutting blade cylinder rotates in cooperation with the folding drum. The folding drum is hollow and subject to large forces due to the cutting forces imparted to it by the cutting blade cylinder. These large cutting forces are apt to create fatigue cracks in the folding drum.

Another limitation of the prior art cylinder folding apparatus is that a number of the components in these devices operate at relatively high spreads of rotation; i.e. high rpm's. These high rotational rates generate high centrifugal forces acting on the folding drum. Consequently, the signatures are pushed out away from the drum into contact with paper guide devices that typically surround the folding drum. This contact between the signatures and the guide devices can result in smearing of the ink on the signatures. In addition, the contact between the signatures and the paper guide devices exerts a braking effect on the signatures. This results in the point spurs, which are used to hold the signatures on the folding drum, causing tears and rips in the signatures.

A further limitation of the prior art devices is that it is not possible to produce stapled tabloid products using these prior art folding cylinders. The ability to produce these types of products is an important one and the lack of this ability in the prior art devices has been an impediment to their usage.

It will thus be seen that there is a need for a folding device that overcomes the limitations of the prior art devices. The cylinder folding apparatus in accordance with the present invention provides such a device in a manner which is a significant improvement over the prior art devices.

SUMMARY OF THE INVENTION

It is an object of the present invention to provide a cylinder folding apparatus.

Another object of the present invention is to provide a cylinder folding apparatus in a web-fed rotary printing press.

A further object of the present invention is to provide a cylinder folding apparatus that is capable of performing collection and double production.

Yet another object of the present invention is to provide a cylinder folding apparatus that can include a stapling device to produce stapled tabloid products.

Still a further object of the present invention is to provide a cylinder folding apparatus that is not susceptible to fatigue cracking.

Even yet a further object of the present invention is to provide a cylinder folding apparatus that is usable to cut thick signatures without damage at high production speeds.

As will be discussed in greater detail in the description of the preferred embodiment which is presented subsequently, the cylinder folding apparatus in accordance with the present invention utilizes a two section solid cutting cylinder and a five section solid counter cutting bar and collection cylinder to sever a paper web train into sections. The section can either be collected on the collection cylinder or can be forwarded directly to a three section hollow folding drum that has a two section folding blade support rotatably positioned within the drum. The axis of rotation of the folding blade support is offset from the axis of rotation of the folding drum. A pair of folding rollers are situated beneath the hollow folding drum and receive the cross folded signatures from the folding drum. A stapling device may be situated adjacent the hollow folding drum and is usable to produce stapled tabloid products.

The cylinder folding apparatus of the present invention has several advantages over the prior art devices. Since the cutting cylinder and the collection cylinder are both provided as solid cylinders, they are much more able to absorb the large cutting forces generated in these devices in a fatigue free manner. This increases the operational life of the cylinder folding apparatus and insures that there will be no cylinder breakage.

The counter cutting bar and collection cylinder, in addition to being constructed in a solid manner, is also made having a large diameter. This allows this cylinder to operate at a selectively slow speed so that large centrifugal forces are not generated. Thus the smearing of the signatures, as has been a problem with the prior art devices, are eliminated, even during collection production.

By embodying the folding drum with a folding blade support whose axis of rotation is offset or eccentric with respect to the axis of rotation of the folding drum, it is possible to operate a stapling device with the folding drum. This allows signatures to be stapled prior to being folded. This is particularly advantageous in the production of tabloid products.

The cylinder folding apparatus in accordance with the present invention overcomes the limitations of the prior art devices. It forms a substantial advance in the art.

BRIEF DESCRIPTION OF THE DRAWINGS

While the novel features of the cylinder folding apparatus in accordance with the present invention are set forth with particularity in the appended claims, a full and complete understanding of the invention may be had by referring to the detailed description of a preferred embodiment which is presented subsequently, and as illustrated in the sole drawing figure which is a schematic side elevation view of a cylinder folding apparatus in accordance with the present invention, with one side of the frames removed for clarity.

DETAILED DESCRIPTION OF THE PREFERRED EMBODIMENT

Referring now to the sole drawing figure, there may be seen a preferred embodiment of a cylinder folding apparatus in accordance with the present invention. The cylinder folding apparatus in accordance with the present invention utilizes a solid 5/2 counter-cutting bar or collection cylinder 1 that is supported in the press side frames for counterclockwise rotation and which is equipped with five generally known, controllable point spur sets 2, 3, 4, 5 and 6, as well as with five also generally known counter-cutting bars 8, 9, 10, 11 and 12. A solid 2/2 cutting cylinder 14, which is supported in the press frames for rotation in a clockwise direction, and which is provided with two cutters 16, 17 located diametrically opposite each other on the periphery of the cylinder 14, is situated adjacent to and on the left side of the 5/2 counter-cutting bar or collection cylinder 1.

A generally known hollow 3/2 folding drum 18, which is provided with three controllable point spur sets 20, 21 and 22, is fixedly seated in the press side frames below the counter-cutting bar cylinder 1. A rotating folding blade cylinder 23 with two folding blades 25 and 26 which cannot be disconnected or disabled and which are located on the periphery of the folding blade cylinder 23 separated by 180°, is disposed in the hollow body of the folding drum 18. An axis of rotation 27 of the folding blade support 23 is located spaced eccentrically from an axis of rotation 28 of the folding drum 18 but within the folding drum 18. The folding blade support 23 is driven at a ratio of 2:3 in relation to the folding drum 18. During one revolution of the folding blade support 23, a front gear wheel of each of the two folding blades 25 and 26 rolls on a fixed sun wheel in such a way that each one of the two folding blades 25 and 26 is forced to make three deflections which are offset by respectively 120° with respect to each other, as depicted in the sole drawing figure. Because of this, respectively two deflections of each of the folding blades 25 and 26 takes place inside the interior of the folding drum 18, and during double production a third deflection of the folding blade 25 or 26 extends the blade outside of the folding drum 28 and pushes the signatures which are to be transversely folded into a roller gap between two folding rollers 30 and 31 that are disposed adjacent to the jacket of the folding drum 18 and below the axis of rotation 28 of the drum 18. During collection production only every second passing signature is pushed into the folding rollers 30 and 31.

Three groups of staple closure devices 32, 33 and 34, which are offset from each other by 120°, are located on the jacket of the folding drum 18. These staple closure devices 32, 33 and 34 cooperate with a generally known stapling device 36 which can be decoupled and which is located to the right of, and next to the folding drum 18. The products on the folding drum 18 can be provided with two staples in the fold before they are folded by the cooperative actions of the folding blades 25 and 26 and the folding rollers 30 and 31.

A paddle wheel 37, that is provided with folded product receiving compartments, is seaned, fixed in the press side frame, below the folding rollers 30 and 31. The folded products are taken from the paddle wheel 37 and are placed on an elevator 39 by means of a circulating, endless timed removal chain 38. A drawing roller group, which consists of two drawing rollers 41 and 42, is disposed fixed in the side frame upstream of the inlet for the paper web train into the counter-cutting bar cylinder 1 or collection cylinder and the cutting cylinder 14.

In operation of the cylinder folding apparatus of the present invention, a paper web train, not specifically shown, enters the folding apparatus through the drawing rollers 41 and 42. A leading edge of the paper train is penetrated by one of the point spur sets 2 to 6 on the collecting cylinder 1. An anti-deflection roller 43 that is fixed on the side frame, can be disposed below the drawing rollers 41 and 42, or after them in the direction of web travel and in an inlet wedge that is formed between the counter-cutting bar cylinder 1 and the cutting cylinder 14. This anti-deflection roller 43 prevents the deflection of the paper web train as it is engaged by the point spur sets 2 to 6. The incoming paper web train is cut into a plurality of separate segments or signatures by means of the cooperation of one of the counter-cutting bars 8 to 12 seated in the counter-cutting bar cylinder 1 with one of the cutters 16 or 17 located in the cutting cylinder 14. These now severed segments are maintained on the counter-cutting bar cylinder 1 by the point spur sets 2 to 6. For collection production, the holders of the cutters 16 and 17 are installed offset with respect to each other by a defined amount, such as, for example 1.5 mm, in relation to the cylinder center, so that the first section of the signatures is cut shorn by 3 mm and the second section is cut longer by 3 mm. Re-cutting of the first section of the signatures is prevented because of these different cut lengths. The counter-cutting bar or collection cylinder 1, as well as the folding drum 18 are partially enclosed by paper guide devices 44 which can consist of rods which are adapted to conform to the shapes of the jacket surface of the counter-cutting bar or collection cylinder 1. The leading edge of the incoming paper web train during non-collect production when it is not held by one of the point spur sets 2 to 6, is deflected by a shunt 46 that is disposed downstream, in the direction of signature travel, of the outlet wedge between the counter-cutting bar cylinder 1 and the cutting cylinder 14, on the periphery of the counter-cutting bar cylinder 1. This shunt 46 closes from a position shown by dashed lines into a position shown by solid lines at a set machine revolution speed, for example>5000 revs/h. The shunt 46 can be a portion of a paper guide device 44 which can be pivoted away from the working cylinder.

During collection production, a first section of the signatures to be collected is guided around the counter-cutting bar or collection cylinder 1 by means of the point spur sets 2 to 6 during a first rotation of the collection cylinder 1. During the second rotation of the collection cylinder 1, the second section of the signatures is picked up by the same point spur sets 2 to 6. The collected signature is then taken over by the folding drum 18 by its point spur sets 20 to 22 shortly before the cutting of the second signature from the paper web train. During double production, the leading edge of the incoming paper web train is taken over by the point spur sets 2 to 6 of the counter-cutting bar cylinder 1 and is then taken over by the point spur sets 20 to 22 disposed on the folding drum 18 shortly before the cutting of the trailing end of the signature from the paper web train. By utilization of the coupled stapling device 36, the signatures can be provided with respectively two staples in the transverse folding direction. The stapled signatures can then be folded in a known manner between the folding rollers 30 and 31 and handed over to the elevator 39 by way of the paddle wheel 37 and the timed removal chain 38.

A production control device generally at 47, which is directed toward the jacket surface of the folding drum 18, is fixedly disposed in the product guide device 44 on the frame between the stapling device 36 and the subsequent folding roller 31. This production control device 47 can consist of a photoelectric cell which, depending on the type of production, determines the presence of a folding product and which causes the machine to stop in the absence of the folding product. It is also possible to employ a 7/2 counter-cutting bar cylinder or collection cylinder (n+1 and unevenly numbered) in place of the 5/2 counter-cutting bar cylinder or collection cylinder. The stapling device 36 can be embodied to be in two or three sections or in a half section.

While a preferred embodiment of a cylinder folding apparatus for a web-fed rotary printing device in accordance with the present invention has been set forth fully and completely hereinabove, it will be apparent to one of skill in the art that a number of changes in, for example the overall sizes of the cylinders, the various drive devices for the cylinders, the specific type of printing done by the printing press and the like may be made without departing from the true spirit and scope of the present invention which is accordingly to be limited only by the following claims.

What is claimed is:

1. A cylinder folding apparatus usable in a web-fed rotary printing press to perform collection and double production, said folding apparatus comprising:

a five section counter-cutting and collection bar cylinder which is operable in collection and double production;

a two section cutting cylinder having cutters and operating with said counter-cutting bar and collection cylinder to cut a paper web train into paper web sections;

a three section hollow folding drum rotatable about a first axis of rotation and positioned to receive paper web sections from said counter-cutting bar and collection cylinder; and a two section folding blade cylinder supported within said hollow folding drum cylinder for rotation about a second axis of rotation offset from said first axis of rotation and having extendable folding blades.

2. The cylinder folding apparatus in accordance with claim 1 further including a paper web train anti-deflective roller positioned in an inlet wedge defined by a point of engagement of said counter-cutting bar cylinder and said cutting cylinder, said anti-deflection roller being located upstream, in a direction of travel of a paper web train, from said counter-cutting bar and said cutting cylinder.

3. The cylinder folding apparatus of claim 1 further including a paper web train and paper web sections deflecting shunt positioned adjacent said counter-cutting bar cylinder and being located downstream, in a direction of travel of a paper web train, of an outlet wedge defined by a point of engagement of said counter-cutting bar cylinder with said cutting cylinder.

4. The cylinder folding apparatus of claim 1 further including a stapling device associated with said three section hollow folding drum.

5. The cylinder folding apparatus of claim 4 further including a production control device positioned adjacent said three section hollow folding drum, after, in a direction of paper web section travel, said stapling device.

6. The cylinder folding apparatus of claim 5 further including a pair of folding rollers positioned adjacent said three section hollow folding drum to receive paper web sections insertable into a folding gap between said pair of folding rollers by one of said folding blades, said production control device being positioned between said stapling device and said pair of folding rollers.

7. The cylinder folding apparatus of claim 1 wherein said counter-cutting bar cylinder and said cutting cylinder are solid cylinders.

8. A cylinder folding apparatus usable in a web-fed rotary printing press to perform collection and double production, said folding apparatus comprising:

a five section counter-cutting bar cylinder;

a two section cutting cylinder having cutters and operating with said counter-cutting bar cylinder to cut a paper web train into paper web sections;

a three section hollow folding drum rotatable about a first axis of rotation and positioned to receive paper web sections from said counter-cutting bar cylinder;

a two section folding blade cylinder supported within said hollow folding drum cylinder for rotation about a second axis of rotation offset from said first axis of rotation and having extendable folding blades; and a paper web train and paper web sections deflecting shunt positioned adjacent said counter-cutting bar cylinder and being located downstream, in a direction of travel of a paper web train, of an outlet wedge defined by a point of engagement of said counter-cutting bar cylinder with said cutting cylinder.

9. A cylinder folding apparatus usable in a web-fed rotary printing press to perform collection and double production, said folding apparatus comprising:

a five section counter-cutting bar cylinder;

a two section cutting cylinder having cutters and operating with said counter-cutting bar cylinder to cut a paper web train into paper web sections;

a three section hollow folding drum rotatable about a first axis of rotation and positioned to receive paper web sections from said counter-cutting bar cylinder;

a two section folding blade cylinder supported within said hollow folding drum cylinder for rotation about a second axis of rotation offset from said first axis of rotation and having extendable folding blades;

a stapling device associated with said three section hollow folding drum; and a production control device positioned adjacent said three section hollow folding drum and after, in a direction of paper web section travel, said stapling device.

10. The cylinder folding apparatus of claim 9 further including a pair of folding rollers positioned adjacent said three section hollow folding drum to receive paper web sections insertable into a folding gap between said pair of folding rollers by one of said folding blades, said production control device being positioned between said stapling device and said pair of folding rollers.

* * * * *